US011384667B2

(12) United States Patent
Parrish

(10) Patent No.: US 11,384,667 B2
(45) Date of Patent: Jul. 12, 2022

(54) EXHAUST AFTERTREATMENT SYSTEM WITH HEATED DOSING CONTROL

(71) Applicant: Faurecia Emissions Control Technologies, USA, LLC, Columbus, IN (US)

(72) Inventor: Tony Parrish, Columbus, IN (US)

(73) Assignee: Faurecia Emissions Control Technologies, USA, LLC, Columbus, IN (US)

( * ) Notice: Subject to any disclaimer, the term of this patent is extended or adjusted under 35 U.S.C. 154(b) by 162 days.

(21) Appl. No.: 16/887,399

(22) Filed: May 29, 2020

(65) Prior Publication Data

US 2021/0372307 A1 Dec. 2, 2021

(51) Int. Cl.

| | |
|---|---|
| ***F01N 9/00*** | (2006.01) |
| ***F01N 3/029*** | (2006.01) |
| ***F01N 3/20*** | (2006.01) |

(52) U.S. Cl.

CPC ..... *F01N 3/0296* (2013.01); *F01N 3/208* (2013.01); *F01N 3/2066* (2013.01); *F01N 2610/10* (2013.01)

(58) Field of Classification Search

CPC ..... F01N 3/0296; F01N 2610/10; F01N 2610/105; F01N 2610/107

See application file for complete search history.

(56) References Cited

U.S. PATENT DOCUMENTS

| | | | |
|---|---|---|---|
| 4,486,270 | A | 12/1984 | Kaasenbrood |
| 5,240,688 | A | 8/1993 | Von Harpe |
| 5,590,521 | A | 1/1997 | Schnaibel |
| 5,827,490 | A | 10/1998 | Jones |
| 6,077,491 | A | 6/2000 | Cooper |
| 7,449,162 | B2 | 11/2008 | Schaller |
| 7,595,034 | B2 | 9/2009 | Nissinen |
| 7,984,609 | B2 | 7/2011 | Doring et al. |
| 8,100,191 | B2 | 1/2012 | Beheshti |
| 8,413,427 | B2 | 4/2013 | Mullins et al. |
| 8,418,443 | B2 | 4/2013 | Millet |
| 8,518,354 | B2 | 8/2013 | Ayyappan |

(Continued)

FOREIGN PATENT DOCUMENTS

| | | |
|---|---|---|
| CH | 707551 | 8/2014 |
| CN | 104265422 | 1/2015 |

(Continued)

OTHER PUBLICATIONS

Zhanfeng Qi, Shusen Li, Xiuli Guo, "Development, Application and Direction of Development of Urea-SCR", International Journal of Multimedia and Ubiquitous Engineering, 2016, pp. 131-142, vol. 11, Issue No. 2016.

(Continued)

*Primary Examiner* — Jonathan R Matthias

(74) *Attorney, Agent, or Firm* — Barnes & Thornburg LLP

(57) ABSTRACT

An exhaust aftertreatment system for use with over-the-road vehicle is disclosed. The exhaust aftertreatment system includes a reducing agent mixer with a mixing can and a heated doser unit configured to inject heated reducing agent into the mixing can for distribution throughout exhaust gases passed through the mixing can. Heating of reducing agent may be selectively applied based on a variety of inputs to a controller.

13 Claims, 2 Drawing Sheets

(56) References Cited

U.S. PATENT DOCUMENTS

Figure 1:
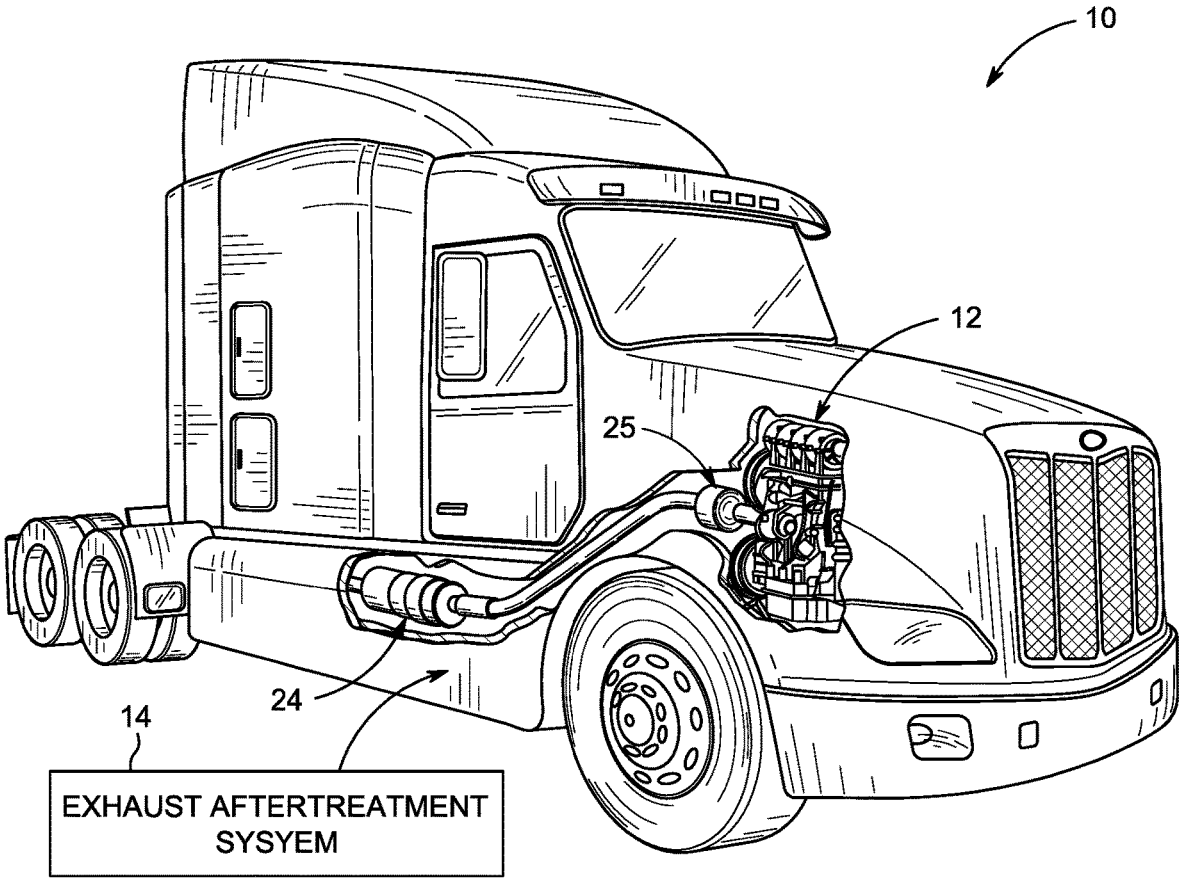

| | | | | |
|---|---|---|---|---|
| 8,763,372 | B2 | 7/2014 | Pohl et al. | |
| 8,800,276 | B2 | 8/2014 | Levin | |
| 8,893,484 | B2 | 11/2014 | Park | |
| 8,967,484 | B2 | 3/2015 | Nishizawa | |
| 8,980,181 | B2 | 3/2015 | Qi | |
| 9,072,850 | B2 | 7/2015 | McIntosh | |
| 9,341,100 | B2 | 5/2016 | Petry | |
| 9,512,760 | B2 | 12/2016 | Clayton, Jr. | |
| 9,598,977 | B2 | 3/2017 | Meyer | |
| 9,683,477 | B2 | 6/2017 | Liljestrand et al. | |
| 9,687,782 | B1 | 6/2017 | Miao | |
| 9,732,650 | B2 | 8/2017 | Tomita | |
| 9,771,850 | B2 | 9/2017 | Henry | |
| 10,337,380 | B2 | 7/2019 | Willats | |
| 2003/0079467 | A1 | 5/2003 | Liu | |
| 2005/0045179 | A1 | 3/2005 | Faison | |
| 2006/0218902 | A1 | 10/2006 | Arellano | |
| 2009/0031713 | A1 | 2/2009 | Suzuki | |
| 2009/0223211 | A1 | 9/2009 | Bruck | |
| 2009/0294552 | A1 | 12/2009 | Trapasso | |
| 2012/0322012 | A1 | 12/2012 | Tsumagari | |
| 2013/0167512 | A1* | 7/2013 | Brueck | F01N 3/208 60/282 |
| 2013/0232956 | A1 | 9/2013 | Loman et al. | |
| 2013/0239549 | A1 | 9/2013 | Henry | |
| 2013/0259755 | A1 | 10/2013 | Kim | |
| 2014/0314644 | A1 | 10/2014 | Bugos | |
| 2014/0363358 | A1 | 12/2014 | Udd | |
| 2015/0135683 | A1 | 5/2015 | Petry | |
| 2015/0315950 | A1 | 11/2015 | Hagimoto | |
| 2016/0017780 | A1 | 1/2016 | Kinugawa | |
| 2016/0053652 | A1 | 2/2016 | Van Vuuren | |
| 2016/0061083 | A1 | 3/2016 | Pramas | |
| 2017/0122169 | A1 | 5/2017 | Ettireddy | |
| 2017/0198621 | A1 | 7/2017 | Gaiser | |
| 2017/0204762 | A1 | 7/2017 | Kotrba | |
| 2018/0080360 | A1 | 3/2018 | Kurpejovic | |
| 2018/0128143 | A1* | 5/2018 | Umemoto | F01N 13/009 |
| 2018/0142593 | A1 | 5/2018 | Wang | |
| 2018/0363527 | A1* | 12/2018 | Everly | F01N 11/00 |
| 2019/0093536 | A1* | 3/2019 | Nakano | F01N 3/106 |
| 2019/0383187 | A1 | 12/2019 | Sarsen | |
| 2020/0131966 | A1 | 4/2020 | Jeannerot | |

FOREIGN PATENT DOCUMENTS

| | | | | |
|---|---|---|---|---|
| DE | 102009005012 | | 7/2010 | |
| DE | 102017101310 | | 8/2017 | |
| DE | 102018209405 | | 12/2019 | |
| EP | 2140117 | | 1/2010 | |
| EP | 2167860 | | 3/2010 | |
| EP | 2302276 | | 3/2011 | |
| EP | 2543837 | | 1/2013 | |
| EP | 2870331 | | 5/2015 | |
| EP | 3330222 | | 6/2018 | |
| EP | 3581773 | | 12/2019 | |
| FR | 3004755 | A1 * | 10/2014 | B01F 5/0473 |
| GB | 2552040 | | 1/2018 | |
| GB | 2562178 | | 11/2018 | |
| GB | 2568269 | | 5/2019 | |
| JP | 2015078643 | | 4/2015 | |
| JP | 2020139426 | | 9/2020 | |
| KR | 20170013687 | | 2/2017 | |
| WO | 199956858 | | 11/1999 | |
| WO | 2005025725 | | 3/2005 | |
| WO | 2006087553 | | 8/2006 | |
| WO | 2007124791 | | 11/2007 | |
| WO | 2008077587 | | 7/2008 | |
| WO | 2008108955 | | 9/2008 | |
| WO | 2013036308 | | 3/2013 | |
| WO | 2018075061 | | 4/2018 | |
| WO | 2018100187 | | 6/2018 | |
| WO | WO-2021062418 | A1 * | 4/2021 | F01N 9/00 |

OTHER PUBLICATIONS

Tue Johannessen, "Compact ammonia storage systems for fuel-efficient NOX emissions reduction", CTI conference on SCR Systems, Jul. 5, 2010.

Anu Solla, Marten Westerholm, Christer Soderstrom, Kauko Tormonen, "Effect of Ammonium Formate and Mixtures of Urea and Ammonium Formate on Low Temperature Activity of SCR Systems", SAE International, 2005.

Daniel Peitz, "Investigations on the catalytic decomposition of guanidinium formate, ammonium formate and methanamide as NH3-precuresors for the selective catalytic reduction of NOX", Univeristy of Erlangen-Nuremberg, 2010.

Extended European Search Report for European Appl. No. 19207724.6, dated Feb. 26, 2020, 8 pages.

Extended European Search Report for European Appl. No. 19203355.3, dated Feb. 26, 2020, 9 pages.

Extended European Search Report for European Appl. No. 19207953.1, dated Mar. 13, 2020, 7 pages.

Office Action dated Apr. 3, 2020, for U.S. Appl. No. 16/184,567 (pp. 1-15).

* cited by examiner

EXHAUST AFTERTREATMENT SYSTEM WITH HEATED DOSING CONTROL

BACKGROUND

The present disclosure relates to exhaust aftertreatment systems for automotive applications, and particularly to mixing devices included in exhaust aftertreatment systems. More particularly, the present disclosure relates to injectors for injecting reducing agents, such as urea solutions, into exhaust streams to mix with the exhaust stream so that chemical reaction between the reducing agent and exhaust gases reduces Nitrous Oxides (NOx) in the exhaust gas.

SUMMARY

An over-the-road vehicle in accordance with the present disclosure including an internal combustion engine that produces exhaust gases and an exhaust aftertreatment system configured to treat the exhaust gases before releasing them into the atmosphere. The exhaust aftertreatment system can include a number of components such as, for example, a diesel oxidation catalyst (DOC), a diesel particulate filter (DPF), one or more selective catalytic reduction units (SCRs), and one or more reducing agent mixers.

The reducing agent mixers can each include a mixing can defining at least a portion of an exhaust passageway for receiving a flow of exhaust gases therein and a doser for injecting reducing agent/reagent into the flow of exhaust gases. The dosers may be configured to selectively heat the reducing agent ahead of injection. Heating the reducing agent can encourage reaction with the flow of exhaust gases to reduce unwanted nitrous oxides (NOx) when system conditions might not otherwise support the reaction.

Dosers configured for selectively heating reducing agent ahead of injection may be part of heated doser units including dedicated heaters and doser controllers. These doser controllers may be configured to operate the heated doser units in heated and unheaded modes. Heating can be applied at various levels and can be applied based on a variety of inputs related to the over-the-road vehicle, the combustion engine, the exhaust gas aftertreatement system, and other factors as discussed in this disclosure.

Additional features of the present disclosure will become apparent to those skilled in the art upon consideration of illustrative embodiments described in this paper.

BRIEF DESCRIPTIONS OF THE DRAWINGS

Figure 2:
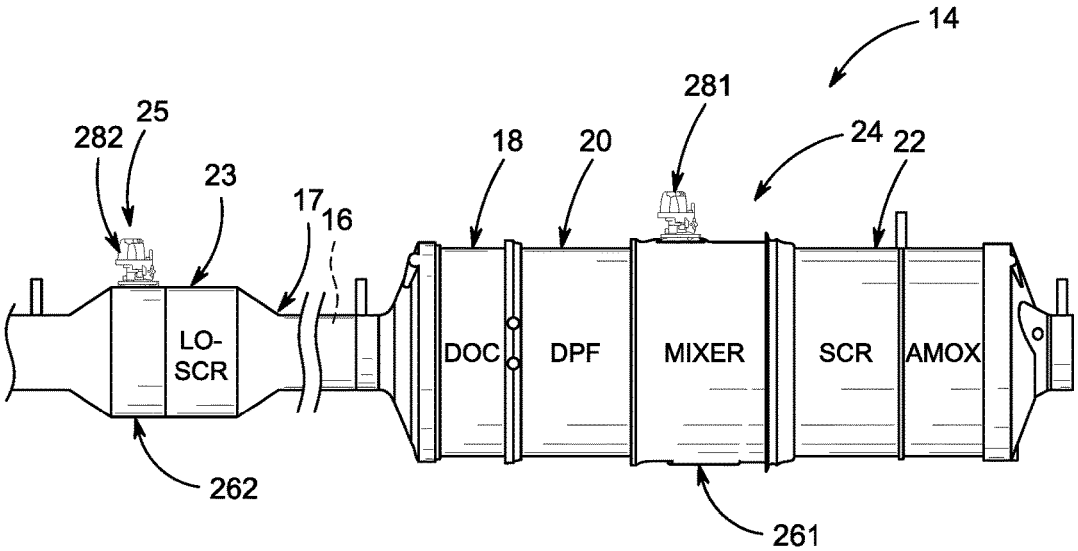
Figure 3:
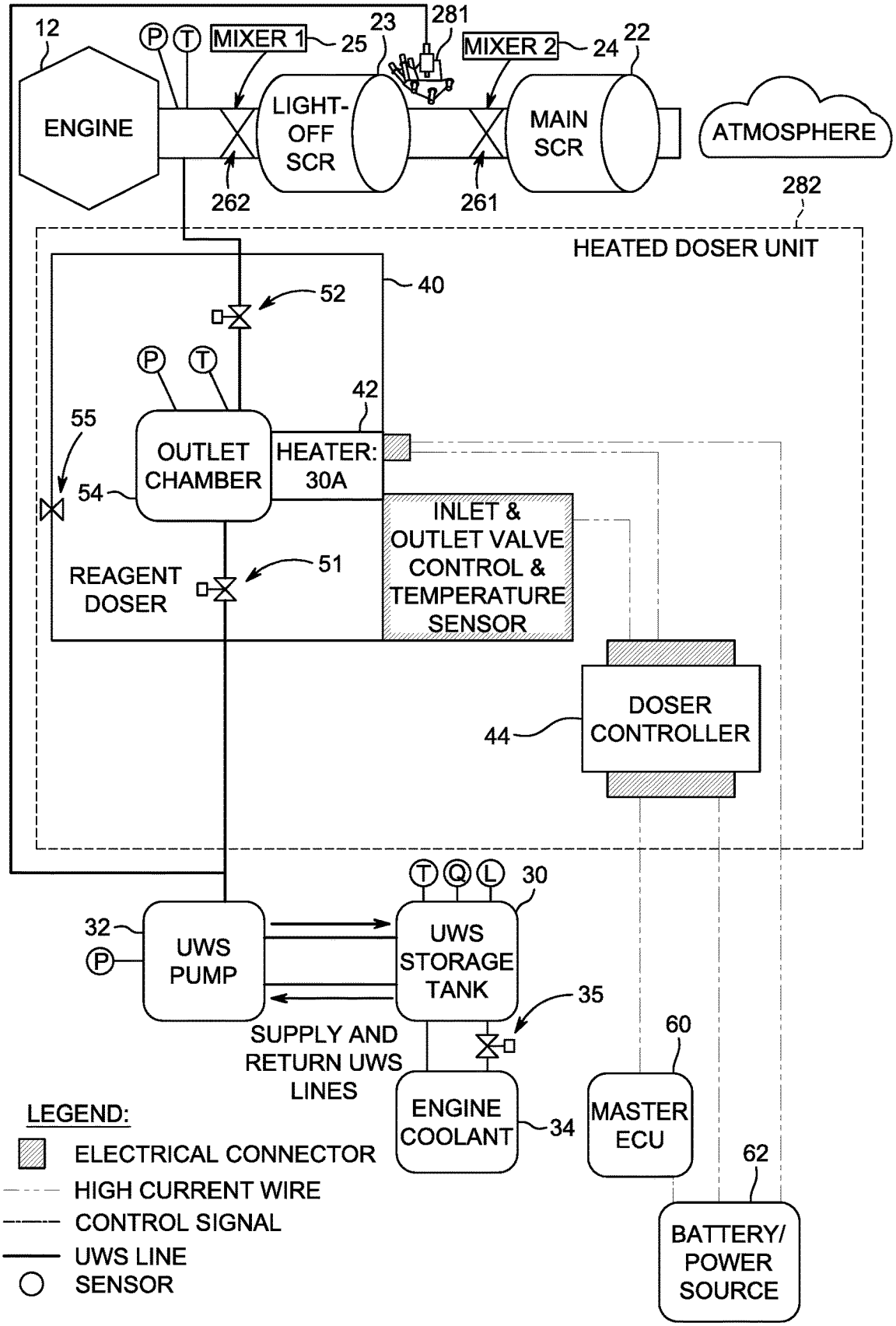

The detailed description particularly refers to the accompanying figures in which:

FIG. 1 is perspective view of an over-the-road automotive vehicle including an internal combustion engine and an exhaust aftertreatment system with an upstream reducing agent mixer located within an engine compartment of the vehicle having a heated doser for injecting a reagent into an exhaust stream and a downstream reducing agent mixer having a doser for adding additional reagent to the exhaust stream so as to chemically react unwanted materials (nitrous oxides/NOx) out of the exhaust gas before the exhaust stream is discharged into the atmosphere;

FIG. 2 is a side elevation view of a portion of the exhaust aftertreatment system from FIG. 1 showing heated doser included in the upstream reducing agent mixer and a second doser included the downstream reducing agent mixer; and FIG. 3 is a diagrammatic view of various components and devices that may be included in the vehicle of FIG. 1 an exhaust aftertreatment system including a reducing agent tank, a reducing agent pump, the heated doser included in the upstream reducing agent mixer, and a control system for operating the reducing agent mixer based on various inputs so as to provide heated dosing control.

DETAILED DESCRIPTION

An illustrative over-the-road vehicle 10 includes an engine 12 an exhaust aftertreatment system 14 in accordance with the present disclosure as shown, for example, in FIG. 1. The engine 12 is, illustratively, an internal combustion engine configured to combust fuel and discharge exhaust gases that are carried through an exhaust passageway 16 defined by an exhaust conduit 17, treated by the exhaust aftertreatment system 14, and then released into the atmosphere. The exhaust aftertreatment system 14 is configured to reduce various effluents in the exhaust gases, such as, for example, nitrogen oxides (NOx), before the exhaust gases are released to the atmosphere.

In the illustrative embodiment, the exhaust aftertreatment system 14 includes a plurality of exhaust aftertreatment devices such as, for example, a diesel oxidation catalyst (DOC) 18, a diesel particulate filter (DPF) 20, and a selective catalytic reduction unit (SCR) 22, and a reducing agent mixer 24. Additional exhaust aftertreatment devices included in the system 14 include a light-off selective catalytic reduction unit (LO-SCR) 23 and a light off reducing agent mixer 25. The LO-SCR 23 and the light off reducing agent mixer 25 are illustratively mounted in the engine compartment, upstream of other components, and can be specifically used at startup of the engine 12.

The exhaust gases pass through or by each of the aftertreatment devices to remove or reduce different effluents. The reducing agent mixers 24, 25 are mounted upstream of associated SCRs 22, 23 and are configured to inject a reducing agent, into exhaust gases. Chemical reaction of the reducing agent with the exhaust gases occurs in the SCRs 22, 23 to reduce $NO_x$ before the exhaust gases are released in the atmosphere.

The reducing agent mixer 24 includes a mixing can 261 and a doser unit 281 as shown in FIGS. 2 and 3. The light off reducing agent mixer 25 includes a mixing can 262 and a heated doser unit 282. The mixing cans 261, 262 are coupled fluidly with the exhaust passageway 16 to receive the exhaust gases flowing therethrough. The doser unit 281 is configured to inject reducing agent (sometimes called reagent, urea solution, DEF, or AdBlue) into the mixing can 261 to mix with exhaust gases, and in some instances, may be heated like heated doser unit 282. The heated doser unit 282 is configured to inject unheated or actively heated reagent into the mixing can 262 to mix with exhaust gases.

The reducing agent is stored on the vehicle 10 in a reducing agent tank 30 and is conducted to the doser units 281, 282 prior to being discharged into the mixing cans 261, 262. In illustrative embodiments, the reducing agent is a urea solution (trade name AdBlue). A pump 32 is provided for supplying reagent to the doser units 281, 282. Also, the reducing agent tank 30 may be coupled via a controlled valve 35 to an engine coolant supply 34 so as to be used as a heat sink for the engine coolant supply 34 as suggested in FIG. 3.

The heated doser unit 282 illustratively includes a reagent doser 40, a heater 42, and a doser controller 44 as shown, diagrammatically, in FIG. 3. The reagent doser 40 pressurizes and controls injection of reagent into a flow of exhaust gas via inlet/outlet valves 51,52 as well as an overpressure valve 55. The heater 42 is coupled to, or integrated with, an outlet chamber 54 of the reagent doser 40 to selectively heat reagent in the doser 40 before discharge into the flow of exhaust gases. The doser controller 44 is coupled to the heater 42, valves 51, 52, and various sensors T, P, etc. so as to direct operation of the heated doser unit 282.

The doser controller 44 is configured to operate the heated doser unit 282 in an unheated mode and a heated mode. In the unheated mode, reagent is injected by the reagent doser 40 without the addition of heat by the heater 42. In heated mode reagent is injected by the reagent doser 40 with the addition of heat by the heater 42.

The heated mode may have one or more levels of operation. For example, at a flash-boil level, the heater 44 may heat the reagent to 160 C before injection. At this temperature the reagent is at the saturated vapor pressure making reaction with NOx in exhaust gases more likely. At a warm-up level, the heater 44 may heat the reagent to less than 160 C before injection. At these temperatures, the regent may be more easily reacted with exhaust gases and/or better distributed through flows of exhaust gas.

In the illustrative embodiment, the doser controller 44 is in communication with sensors measuring temperatures T, pressures P, flow rates Q, fill levels L and the like within the heated doser unit 282 and throughout the vehicle 10 as suggested in FIG. 3. In some instances, the doser controller 44 may be linked to sensors and other systems in/around the vehicle 10 via a master engine control unit (ECU) 60. In other embodiments, controller modules may be combined or separated to provide functionality of a doser controller 44/ECU 60 as would be appreciated in the art.

In illustrative embodiments, the doser controller 44 is configured to determine an energy availability ratio based on various inputs. The energy availability ratio is associated with an amount of energy in the exhaust gas divided by the amount of energy needed to vaporize the urea in the flow of exhaust gases. In the illustrative embodiment, the controller calculates the energy availability ratio based on a temperature of the flow of exhaust gases, a flowrate of the flow of exhaust gases, a demanded flow rate of the reagent, and ambient temperature. In other embodiments, other inputs may be used to calculate or estimate the energy availability ratio so as to determine the ratio for purposes of heated doser unit 282 control. For example, the energy availability ratio can be calculated using the above noted inputs along with exhaust pressure, ambient pressure, etc. or can be estimated using only exhaust temperature. Accordingly, the particular set of inputs considered to determine energy availability ratio is flexible and may include one or more relevant factors.

The exemplary doser controller 44 is configured to operate the heated doser unit 282 in unheated mode when the energy availability ratio is at or above a predetermined reaction threshold. The doser controller is further configured to operate the heated doser unit 282 in heated mode, more specifically at the flash-boil level, when the energy availability ratio is at or below the predetermined reaction threshold. Accordingly, energy is only used to heat reagent when desired to reduce NOx in the exhaust gases at the expense of overall carbon creation by the engine 12 or use of energy in a battery 62.

In the illustrated embodiment, the doser controller 44 may be configured to make exceptions and operation in unheated/heated mode in opposition to the energy availability ratio determined based on various inputs. By doing this, operation can be refined and optimized for the associated vehicle 10 and it's expected operation. As specific examples, the doser controller 44 may make exceptions to operation in view of energy availability ratio in view of: exhaust aftertreatment system information, vehicle information, engine information, accessory information, and/or exhaust gas chemistry information. These examples are not exhaustive and other inputs may be considered.

Exhaust aftertreatement system information that may be considered by the doser controller 44 to drive an exception and operation in opposition to the energy availability ratio determined. In particular, exhaust aftertreatement system information may include one or more of status of a diesel particulate filter regeneration event, status of an exhaust aftertreatement system catalyst de-sulphation event, reagent deposit detection, and time since last switch from one mode to another. A diesel particulate filter regeneration event may indicate heat added to the exhaust aftertreatment system 14 such that heating of the doser may not be required in spite of energy availability ratio determined. A system catalyst de-sulfation event may indicate high (or low) efficacy of the LO-SCR/SCR 23, 22 such that heating may needed (or not) in opposition to energy availability ratio determined. Reagent deposit detection may be determined via pressures or other inputs and may indicate desirability of heating (or not) in opposition to energy availability ratio determined. Of course other inputs associated with the exhaust aftertreatement system 14 (temperatures, pressures, etc) may also be considered to drive exception operation.

Vehicle information that may be considered by the doser controller 44 to drive an exception and operation in opposition to the energy availability ratio determined. In particular, vehicle information may include one or more of vehicle speed, key-switch status, vehicle gear selection, exhaust gas recirculation percentage, and diagnostic fault detection and activation status. These and other pieces of vehicle information can anticipate or indicate the desirability of heater 42 operation in opposition to energy availability ratio determined by the doser controller 44 so as to meet or exceed regulations related to NOx and/or to manage power consumption by the heated doser unit 282 in view of other vehicle 10 systems. In the illustrative embodiment, vehicle information is provided to the doser controller 44 by the master ECU 60.

Engine information that may be considered by the doser controller 44 to drive an exception and operation in opposition to the energy availability ratio determined. In particular, engine information may include one or more of cylinder de-activation, engine/exhaust brake state, engine coolant temperature, engine speed, engine torque, intake manifold pressure, and intake manifold temperature, and engine fuel flowrate. These and other pieces of engine information can anticipate or indicate the desirability of heater 42 operation in opposition to energy availability ratio determined by the doser controller 44. In the illustrative embodiment, engine information is provided to the doser controller 44 by the master ECU 60.

Accessory information that may be considered by the doser controller 44 to drive an exception and operation in opposition to the energy availability ratio determined. In particular, accessory information may include one or more of power take off (PTO) system status, and external scan tool status. These and other pieces of accessory information can anticipate or indicate the desirability of heater 42 operation in opposition to energy availability ratio determined by the doser controller 44. For example, upon PTO engagement, power may need to be diverted from heated doser unit 282 (change to unheated mode) or additional exhaust creation anticipated (change to heated mode). External scan tool status may drive automatic heated mode operation so as to confirm heated doser unit 282 suitability for normal operation. In the illustrative embodiment, accessory information is provided to the doser controller 44 by the master ECU 60.

Exhaust gas chemistry information that may be considered by the doser controller 44 to drive an exception and operation in opposition to the energy availability ratio determined. In particular, exhaust gas chemistry information may include one or more of nitrous oxide concentration in an exhaust line, ammonia concentration in the exhaust line, and oxygen concentration in the exhaust line. These and other pieces of chemistry information can anticipate or indicate the desirability of heater 42 operation in opposition to energy availability ratio determined by the doser controller 44. In the illustrative embodiment, chemistry information is provided to the doser controller 44 by the master ECU 60.

In some embodiments, the doser controller 44 may be configured to make exception and to operate in heated/unheated mode in opposition to the determined energy availability ratio based upon a mixing uniformity factor. The mixing uniformity factor is associated with uniformity of reagent distribution within the flow of exhaust gases ahead of and/or upon interaction with a catalyst included in the LO-SCR 23 of the exhaust gas aftertreatment system 14. The mixing uniformity factor may be determined (calculated, estimated, looked up) based on flowrate of the flow of exhaust gases, the demanded flow rate of the reagent, and/or other factors.

In some embodiments, the doser controller 44 may be configured to operate the heated doser unit in heated/unheated mode based on the mixing uniformity factor without determination of or regard for energy availability ratio. More specifically the doser controller 44 may operate the heated doser unit 282 in unheated mode when the mixing uniformity factor is at or above a predetermined uniformity threshold. Further, the doser controller 44 may operate the heated doser unit 282 in heated mode (specifically warm-up mode) when the mixing uniformity factor is below the predetermined uniformity threshold.

Heated doser unit 282 can control the urea state inside the heated chamber 54 of a doser 40 by using the parameters measured on engine and aftertreatment to switch between heated and non-heated mode. Some doser units are only capable of running in the non-heated mode. Such dosers are limited by the exhaust gas temperature parameter (among other things) to not dose below typically 180 Degrees C. This is because they could form significant urea deposits leading to potential blockage of the aftertreatment system, and could result in a lack of conversion of the urea to the ammonia needed for the NOx reduction catalytic reaction due to lack of exhaust temperature (or other factors).

The heated doser unit 282 in the present disclosure provides small droplets in heated mode to enable enhanced generation of ammonia below 180 Deg C exhaust gas temperature. It can accordingly be effective to much lower exhaust temperatures (e.g. 130 or 150 Degrees C.). While running in this heated mode, a small power consumption may be required to power the urea heater 42 incorporated in the doser. It may be advantageous to be able to turn off the power to the heater to run in non-heated mode when it is not needed at higher exhaust temperatures (eg 180 degrees plus) this saves power consumption.

In addition in the heated mode the flow rate can be limited by the power available in the heater 42 and flow rates required at high engine power (and consequently high exhaust temperatures) may not be achieved in heated mode. Operating in the non-heated mode can overcome this potential limitation of the heated doser unit 282.

The effect of operation in two modes, controlled by aftertreatment and/or other parameters is that it changes the operating mode of the doser and the state of the urea within the doser 40. Low exhaust temperature—urea heated mode—urea may be a superheated fluid vapor mix, and may be injected in a mode which promotes instant boiling of some of the fluid when it is ejected through the outlet nozzle. High exhaust temperature—non heated mode—urea is at ambient temperature, below its boiling point and injected as a normal fluid.

The present disclosure provides, among other things, methods and logic for determining when to switch between heated and non-heated mode of dosing. The controller 44 can use various data from the vehicle 10 and the environment to determine when to switch from one mode to the other. Doser controller 44 can provide optimized performance, minimize deposit formation, optimize for spray characteristics (droplet size, spray angle, velocity, vapor fraction) when needed, and manage power usage.

Software inside the controller 44 and/or ECU 60 may be programmed with logic, control laws, and calibration parameters that will determine when to switch from heated dosing mode to non-heated dosing mode. The inputs into that software may include, but are not limited to, the following: exhaust temperature, exhaust flow rate, exhaust pressure, ambient temperature, ambient pressure, UWS dosing flowrate demand, status of DPF regeneration event, status of SCR de-sulphation event, vehicle speed, engine speed, engine torque, intake manifold pressure, intake manifold temperature, time since the last switch from one mode to another, diagnostic fault detection and activation status, communication with an external scan tool, UWS pump pressure, UWS temperature at the inlet of the doser, vehicle gear selection, exhaust gas recirculation percentage, cylinder de-activation, engine/exhaust brake state, engine coolant temperature, Nox concentration in the exhaust line, NH3 concentration in the exhaust line, oxygen concentration in the exhaust line, UWS flowrate demand to other doser(s) in the exhaust line, PTO status, key-switch status, or engine fuel flowrate.

The following numbered clauses include embodiments that are contemplated and non-limiting:

Clause 1. An exhaust aftertreatment system for an over-the-road vehicle, the system comprising a mixing can defining at least a portion of an exhaust passageway for receiving a flow of exhaust gases therein, and a heated doser unit including a reagent doser configured to inject reagent into the flow of exhaust gases in the mixing can, a heater coupled to the reagent doser to heat reagent in the reagent doser, and a doser controller configured to control injection of the reagent by the reagent doser and heating of the reagent by the heater, wherein the heated doser unit is configured to operate in (1) an unheated mode, in which reagent is injected by the reagent doser without the addition of heat by the heater, and (2) a heated mode, in which reagent is injected by the reagent doser with the addition of heat by the heater.

Clause 2. The system of clause 1, any other suitable clause, or combination of clauses, wherein the doser controller is configured to determine an energy availability ratio associated with an amount of energy in the flow of exhaust gases divided by the amount of energy needed to vaporize the urea, the doser controller is configured to operate the heated doser unit in unheated mode when the energy availability ratio is at or above a predetermined reaction threshold, and the doser controller is configured to operate the heated doser unit in heated mode when the energy availability ratio is below the predetermined reaction threshold.

Clause 3. The system of clause 2, any other suitable clause, or combination of clauses, wherein the doser controller calculates the energy availability ratio based on a temperature of the flow of exhaust gases, a flowrate of the flow of exhaust gases, a demanded flow rate of the reagent, and ambient temperature.

Clause 4. The system of clause 2, any other suitable clause, or combination of clauses, wherein the doser controller is configured to make exception and to operate in heated mode when the energy availability ratio is below the predetermined reaction threshold or to operate in unheated mode when the energy availability ratio is above the predetermined reaction threshold based upon exhaust aftertreatment system information including at least one of: status of a diesel particulate filter regeneration event, status of an exhaust aftertreatement system catalyst de-sulphation event, and time since last switch from one mode to another.

Clause 5. The system of clause 2, any other suitable clause, or combination of clauses, wherein the doser controller is configured to make exception and to operate in heated mode when the energy availability ratio is below the predetermined reaction threshold or to operate in unheated mode when the energy availability ratio is above the predetermined reaction threshold based upon vehicle information including at least one of: vehicle speed, key-switch status, vehicle gear selection, exhaust gas recirculation percentage, and diagnostic fault detection and activation status.

Clause 6. The system of clause 2, any other suitable clause, or combination of clauses, wherein the doser controller is configured to make exception and to operate in heated mode when the energy availability ratio is below the predetermined reaction threshold or to operate in unheated mode when the energy availability ratio is above the predetermined reaction threshold based upon engine information including at least one of: cylinder de-activation, engine/exhaust brake state, engine coolant temperature, engine speed, engine torque, intake manifold pressure, intake manifold temperature, and engine fuel flowrate.

Clause 7. The system of clause 2, any other suitable clause, or combination of clauses, wherein the doser controller is configured to make exception and to operate in heated mode when the energy availability ratio is below the predetermined reaction threshold or to operate in unheated mode when the energy availability ratio is above the predetermined reaction threshold based upon accessory information including at least one of: power take off system status, and external scan tool status.

Clause 8. The system of clause 2, any other suitable clause, or combination of clauses, wherein the doser controller is configured to make exception and to operate in heated mode when the energy availability ratio is below the predetermined reaction threshold or to operate in unheated mode when the energy availability ratio is above the predetermined reaction threshold based upon exhaust gas chemistry information including at least one of: nitrous oxide concentration in an exhaust line, ammonia concentration in the exhaust line, and oxygen concentration in the exhaust line.

Clause 9. The system of clause 2, any other suitable clause, or combination of clauses, wherein the doser controller is configured to make exception and to operate in heated mode when the energy availability ratio is below the predetermined reaction threshold based upon a mixing uniformity factor associated with uniformity of reagent distribution within the flow of exhaust gases upon interaction with a catalyst included in the exhaust gas aftertreatment system.

Clause 10. The system of clause 9, any other suitable clause, or combination of clauses, wherein the mixing uniformity factor is determined based on at least one of flowrate of the flow of exhaust gases and the demanded flow rate of the reagent.

Clause 11. The system of clause 1, any other suitable clause, or combination of clauses, wherein the doser controller is configured to determine a mixing uniformity factor associated with uniformity of reagent distribution within the flow of exhaust gases upon interaction with a catalyst included in the exhaust gas aftertreatment system, the doser controller is configured to operate the heated doser unit in unheated mode when the mixing uniformity factor is at or above a predetermined uniformity threshold, and the doser controller is configured to operate the heated doser unit in heated mode when the mixing uniformity factor is below the predetermined uniformity threshold.

Clause 12. The system of clause 11, any other suitable clause, or combination of clauses, wherein the mixing uniformity factor is determined based on at least one of flowrate of the flow of exhaust gases and the demanded flow rate of the reagent.

13. An over the road vehicle, the vehicle comprising an internal combustion engine configured to produce a flow of exhaust gases that are conducted through an exhaust passageway defined by an exhaust conduit, and an exhaust aftertreatment system according to any one of clauses 1-12 (including suitable combinations thereof) fluidly coupled to the internal combustion engine.

The invention claimed is:

1. An exhaust aftertreatment system for an over-the-road vehicle, the system comprising a mixing can defining at least a portion of an exhaust passageway for receiving a flow of exhaust gases therein, and a heated doser unit including a reagent doser configured to inject reagent into the flow of exhaust gases in the mixing can, a heater coupled to the reagent doser to heat reagent in the reagent doser, and a doser controller configured to control injection of the reagent by the reagent doser and heating of the reagent by the heater, wherein the doser controller is configured to operate the heated doser unit in (1) an unheated mode, in which reagent is injected by the reagent doser without the addition of heat by the heater, and (2) a heated mode, in which reagent is injected by the reagent doser with the addition of heat by the heater, wherein the doser controller is configured to determine an energy availability ratio associated with the amount of energy in the exhaust gas divided by the amount of energy needed to vaporize the urea, the doser controller is configured to operate the heated doser unit in the unheated mode when the energy availability ratio is at or above a predetermined reaction threshold, and the doser controller is configured to operate the heated doser unit in the heated mode when the energy availability ratio is below the predetermined reaction threshold, and wherein the doser controller is configured to make exception and to operate the heated doser unit in the unheated mode when the energy availability ratio is below the predetermined reaction threshold or to operate the heated doser unit in the heated mode when the energy availability ratio is above the predetermined reaction threshold based upon at least one of exhaust aftertreatment system information, vehicle information, engine information, accessory information, and exhaust gas chemistry information.

2. The system of claim 1, wherein the doser controller calculates the energy availability ratio based on a temperature of the flow of exhaust gases, a flowrate of the flow of exhaust gases, a demanded flow rate of the reagent, and ambient temperature.

3. The system of claim 1, wherein the exhaust aftertreatment system information includes at least one of:

status of a diesel particulate filter regeneration event, status of an exhaust aftertreatement system catalyst desulphation event, and time since last switch from one mode to another.

4. The system of claim 1, wherein the vehicle information includes at least one of:

vehicle speed, key-switch status, vehicle gear selection, exhaust gas recirculation percentage, and diagnostic fault detection and activation status.

5. The system of claim 1, wherein the engine information includes at least one of:

cylinder de-activation, engine/exhaust brake state, engine coolant temperature, engine speed, engine torque, intake manifold pressure, intake manifold temperature, and engine fuel flowrate.

6. The system of claim 1, wherein the accessory information includes at least one of:

power take off system status, and external scan tool status.

7. The system of claim 1, wherein the exhaust gas chemistry information includes at least one of:

nitrous oxide concentration in an exhaust line, ammonia concentration in the exhaust line, and oxygen concentration in the exhaust line.

8. An exhaust aftertreatment system for an over-the-road vehicle, the system comprising a mixing can defining at least a portion of an exhaust passageway for receiving a flow of exhaust gases therein, and a heated doser unit including a reagent doser configured to inject reagent into the flow of exhaust gases in the mixing can, a heater coupled to the reagent doser to heat reagent in the reagent doser, and a doser controller configured to control injection of the reagent by the reagent doser and heating of the reagent by the heater, wherein the doser controller is configured to operate the heated doser unit in (1) an unheated mode, in which reagent is injected by the reagent doser without the addition of heat by the heater, and (2) a heated mode, in which reagent is injected by the reagent doser with the addition of heat by the heater, wherein the doser controller is configured to determine an energy availability ratio associated with the amount of energy in the exhaust gas divided by the amount of energy needed to vaporize the urea, the doser controller is configured to operate the heated doser unit in the unheated mode when the energy availability ratio is at or above a predetermined reaction threshold, and the doser controller is configured to operate the heated doser unit in the heated mode when the energy availability ratio is below the predetermined reaction threshold, and wherein the doser controller is configured to make exception and to operate the heated doser unit in the heated mode when the energy availability ratio is above the predetermined reaction threshold or to operate the heated doser unit in the unheated mode when the energy availability ratio is below the predetermined reaction threshold based upon a mixing uniformity factor associated with uniformity of reagent distribution within the flow of exhaust gases upon interaction with a catalyst included in the exhaust gas aftertreatment system.

9. The system of claim 8, wherein the mixing uniformity factor is determined based on at least one of flowrate of the flow of exhaust gases and the demanded flow rate of the reagent.

10. The system of claim 8, wherein the doser controller is configured to determine the mixing uniformity factor associated with uniformity of reagent distribution within the flow of exhaust gases upon interaction with a catalyst included in the exhaust gas aftertreatment system, the doser controller is configured to operate the heated doser unit in the unheated mode when the mixing uniformity factor is at or above a predetermined uniformity threshold, and the doser controller is configured to operate the heated doser unit in the heated mode when the mixing uniformity factor is below the predetermined uniformity threshold.

11. The system of claim 10, wherein the mixing uniformity factor is determined based on at least one of flowrate of the flow of exhaust gases and the demanded flow rate of the reagent.

12. An over the road vehicle, the vehicle comprising an internal combustion engine configured to produce a flow of exhaust gases that are conducted through an exhaust passageway defined by an exhaust conduit, and an exhaust aftertreatment system fluidly coupled to the internal combustion engine, the exhaust aftertreatment system including a mixing can defining at least a portion of an exhaust passageway for receiving a flow of exhaust gases therein, and a heated doser unit including a reagent doser configured to inject reagent into the flow of exhaust gases in the mixing can, a heater coupled to the reagent doser to heat reagent in the reagent doser, and a doser controller configured to control injection of the reagent by the reagent doser and heating of the reagent by the heater, wherein the doser controller is configured to operate the heated doser unit in (1) an unheated mode, in which reagent is injected by the reagent doser without the addition of heat by the heater, and (2) a heated mode, in which reagent is injected by the reagent doser with the addition of heat by the heater, wherein the doser controller is configured to determine an energy availability ratio the amount of energy in the exhaust gas divided by the amount of energy needed to vaporize the urea, the doser controller is configured to operate the heated doser unit in the unheated mode when the energy availability ratio is at or above a predetermined reaction threshold, and the doser controller is configured to operate the heated doser unit in the heated mode when the energy availability ratio is below the predetermined reaction threshold, wherein the doser controller is configured to determine a mixing uniformity factor associated with uniformity of reagent distribution within the flow of exhaust gases upon interaction with a catalyst included in the exhaust gas aftertreatment system, and wherein the doser controller is configured to make exception and to operate the heated doser unit in the heated mode when the energy availability ratio is above the predetermined reaction threshold or to operate the heated doser unit in the unheated mode when the energy availability ratio is below the predetermined reaction threshold based upon the mixing uniformity factor.

13. The system of claim 12, wherein the doser controller is configured to operate the heated doser unit in the unheated mode when the mixing uniformity factor is at or above a predetermined uniformity threshold, and the doser controller is configured to operate the heated doser unit in the heated mode when the mixing uniformity factor is below the predetermined uniformity threshold.

* * * * *